US009945271B2

(12) United States Patent
Suzuki et al.

(10) Patent No.: US 9,945,271 B2
(45) Date of Patent: Apr. 17, 2018

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Shigemitsu Suzuki, Takahama (JP); Naoto Toma, Kariya (JP); Hiroki Mukaide, Chiryu (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 95 days.

(21) Appl. No.: 15/120,548

(22) PCT Filed: Dec. 24, 2014

(86) PCT No.: PCT/JP2014/084133
§ 371 (c)(1),
(2) Date: Aug. 22, 2016

(87) PCT Pub. No.: WO2015/129137
PCT Pub. Date: Sep. 3, 2015

(65) Prior Publication Data

US 2017/0009614 A1 Jan. 12, 2017

(30) Foreign Application Priority Data

Feb. 25, 2014 (JP) ..... 2014-034480

(51) Int. Cl.
*F01L 1/46* (2006.01)
*F01L 1/344* (2006.01)

(52) U.S. Cl.
CPC ..... *F01L 1/3442* (2013.01); *F01L 1/46* (2013.01); *F01L 2001/34423* (2013.01);
(Continued)

(58) Field of Classification Search
CPC ... F01L 2001/34423; F01L 2001/34463; F01L 1/46; F01L 2800/01
(Continued)

(56) References Cited

U.S. PATENT DOCUMENTS 5,738,056 A 4/1998 Mikame et al.
2013/0146005 A1* 6/2013 Watanabe ..... F01L 1/3442 123/90.15

FOREIGN PATENT DOCUMENTS

JP 9-324613 A 12/1997
JP 2000-345815 A 12/2000
JP 2012-241599 A 12/2012

OTHER PUBLICATIONS

Notification of Transmittal of Translation of the International Preliminary Report on Patentability (Form PCT/IB/338 and PCT/IB/373) and English Translation of the Written Opinion of the International Searching Authority (Forms PCT/ISA/237) dated Sep. 9, 2016, by the International Bureau of WIPO in corresponding International Application No. PCT/JP2014/084133. (7 pgs).
(Continued)

*Primary Examiner* — Jorge Leon, Jr.
(74) *Attorney, Agent, or Firm* — Buchanan, Ingersoll & Rooney PC

(57) ABSTRACT

Provided is a valve opening/closing timing control device that can speedily achieve a stable operation at the time of starting an engine. The device includes a drive-side rotating body that is rotated in synchronism with a crankshaft and has a plurality of projecting portions, a driven-side rotating body that has a partition portion which forms an advance angle chamber and a retard angle chamber and that is rotated together with a camshaft for valve opening/closing, an intermediate lock mechanism switchable between a locked state and an unlocked state, a pump for supplying fluid to the advance angle chamber, the retard angle chamber or the
(Continued)

intermediate lock mechanism, and a communication passage configured to establish communication between the advance angle chamber and the retard angle chamber disposed adjacent in a circumferential direction when the intermediate lock mechanism is under the locked state.

5 Claims, 7 Drawing Sheets

(52) U.S. Cl.
CPC ..... *F01L 2001/34453* (2013.01); *F01L 2001/34459* (2013.01); *F01L 2001/34463* (2013.01); *F01L 2001/34473* (2013.01); *F01L 2001/34476* (2013.01)

(58) Field of Classification Search
USPC ..... 123/90.15, 90.17
See application file for complete search history.

(56) References Cited

OTHER PUBLICATIONS

International Search Report (PCT/ISA/210) dated Mar. 17, 2015, by the Japanese Patent Office as the International Searching Authority for International Application No. PCT/JP2014/084133.
Written Opinion (PCT/ISA/237) dated Mar. 17, 2015, by the Japanese Patent Office as the International Searching Authority for International Application No. PCT/JP2014/084133.

* cited by examiner

VALVE OPENING/CLOSING TIMING CONTROL DEVICE

TECHNICAL FIELD

This disclosure relates to a valve opening/closing timing control device having an intermediate lock mechanism for restraining a relative rotational phase of a driven-side rotating body relative to a drive-side rotating body to a phase between a most advanced angle phase and a most retarded angle phase.

BACKGROUND ART

At the time of starting an engine, if a relative rotational phase of a driven-side rotating body relative to a drive-side rotating body is set to a most retarded angle phase, with resultant retardation of the closing timing of an intake valve, mixture gas present inside a combustion chamber can flow reversely into an intake pipe, thus leading to disadvantageous reduction in a compression ratio inside the combustion chamber, which invites deterioration of start-up performance. On the other hand, at the time of starting the engine, if the relative rotational phase of the driven-side rotating body relative to the drive-side rotating body is set to a most advanced angle phase, with resultant increase in the valve overlap period, an amount of residual exhaust gas inside the combustion chamber will increase, thus inviting deterioration of start-up performance again.

For this reason, in an attempt to improve the engine start-up performance, there is known a valve opening/closing timing control device configured to restrain the relative rotational phase to an intermediate phase between the most advanced angle phase and the most retarded angle phase (see e.g. Patent Document 1).

An intermediate lock mechanism disclosed in Patent Document 1 includes a locking member and a lock recess into which the locking member engages. And, the locking member includes a first pressure receiving face and a second pressure receiving face, to which an oil pressure for releasing lock is to be applied. Further, the first pressure receiving face is in communication with a retard angle chamber whereas the second pressure receiving face is in communication with an advance angle chamber.

When the pump is stopped after engine stop, oils present inside the advance angle chamber and the retard angle chamber are drained into an oil pan, and also, the oil pressure applied to the locking member is now reduced, thus realizing a locked state. Thereafter, when the engine is started, oil is fed into the advance angle chamber, and when the second pressure receiving face is subjected to a predetermined pressure, the locked state is released, so that an advance angle control is effected. In succession, at time of execution of a retard angle control, oil is fed into the retard angle chamber, so that an oil pressure is applied to the first pressure receiving face, thereby maintaining an unlocked state, in which state the relative rotational phase is changed to a retard angle side.

CITATION LIST

Patent Literature

Patent Document 1: JPH 09-324613A

SUMMARY OF INVENTION

Technical Problem

Oil in the advance angle chamber and oil in the retard angle chamber are discharged when the engine is stopped. Therefore, at the time of starting the engine, the amounts of oils in the advance angle chamber and the retard angle chamber are small. Namely, in the case of the valve opening/closing timing control device disclosed in Patent Document 1, at the time of engine start, when locked state is released by supplying oil into the advance angle chamber, the amount of oil present inside the retard angle chamber is small.

For this reason, under a reaction force from the intake valve, the cam shaft will be rotated repeatedly in the advance angle/retard angle directions. As a result, there occurs "fluttering" of the relative rotational phase, so that the control becomes unstable. Further, a partition portion provided in the driven-side rotating body for partitioning between the advance angle chamber and the retard angle chamber comes into contact with a lateral wall of the retard angle chamber repeatedly, so that there may occur generation of noise also.

To avoid the above problem, it is conceivable to supply oil into the retard angle chamber before lock releasing. In such case, there will be executed a control such that oil is charged into the advance angle chamber first and then a flow passage is switched over by e.g. an electromagnetic valve to charge oil into the retard angle chamber, hence, releasing the locked state. However, since the oil temperature is low at the time of engine start, it takes long time until completion of oil filling in the retard angle chamber by means of switchover of the flow passage by the electromagnetic valve.

In view of the above, the object of the present disclosure is to provide a valve opening/closing timing control device that can speedily realize a stable operation speedily at the time of engine start.

Solution to Problem

According to a characterizing feature of a valve opening/closing timing control device relating to the present invention, the device comprises:

a drive-side rotating body rotatable in synchronism with a crankshaft of an internal combustion engine, the drive-side rotating body having a plurality of projecting portions that project from a radial outer side to a radial inner side toward a rotational axis;

a driven-side rotating body surrounded by the drive-side rotating body and having a partition portion extending toward the radial outer side at a position between the adjacent projecting portions, thus forming an advance angle chamber and a retard angle chamber between the drive-side rotating body and the drive-side rotating body, the driven-side rotating body being rotatable together with a valve opening/closing camshaft;

an intermediate lock mechanism switchable between a locked state in which a relative rotational phase of the driven-side rotating body relative to the drive-side rotating body is restrained to an intermediate lock phase between a most advanced angle phase and a most retarded angle phase and an unlocked state in which the restraint is released;

a pump configured to supply fluid to the advance angle chamber, the retard angle chamber or the intermediate lock mechanism; and a communication passage configured to establish communication between the advance angle chamber and the retard angle chamber which are located adjacent each other in a circumferential direction, when the intermediate lock mechanism is under the locked state.

With the above-described subject feature, communication between the advance angle chamber and retard angle chamber is established via the communication passage only when the intermediate lock mechanism is under the locked state. Namely, at the time of engine start, the fluid supplied to e.g. the advance angle chamber moves through the communication passage to the retard angle chamber, whereby the advance angle chamber and the retard angle chamber are filled with the fluid. Then, with supply of fluid to the intermediate lock mechanism, the lock is released, and in association with change in the relative rotational phase, the communication between the advance angle chamber and the retard angle chamber is blocked. Thus, since the lock is released when a sufficient amount of fluid is present in the advance angle chamber and the retard angle chamber, so that a relative rotational phase control can be realized favorably and also no noise due to fluttering (vibration) of the partition portion will be generated.

Moreover, since the fluid moves between the advance angle chamber and the retard angle chamber via the communication passage, the charging operation of fluid to the advance angle chamber and the retard angle chamber can be completed only by supplying the fluid to either the advance angle chamber alone or the retard angle chamber alone. Therefore, at the time of engine start, there will be required no such control operation of switching over a flow passage by means of an electromagnetic valve in order to charge fluid to the advance angle chamber and the retard angle chamber separately. Thus, with elimination of time loss associated with flow passage switchover, supplying of fluid to the advance angle chamber and the retard angle chamber can be effected speedily.

In this way, with the above-described simple arrangement of providing a communication passage for establishing communication between the advance angle chamber and the retard angle chamber when the intermediate lock mechanisms is under the locked state, there has been realized a valve opening/closing timing control device that can speedily realize a stable operation at the time of engine start.

According to a further characterizing feature, the communication passage is formed by cutting out a portion of the driven-side rotating body which portion faces an end portion of the projecting portion.

With this feature, of the driven-side rotating body located on the inner side of the drive-side rotating body, a portion thereof facing the end portion of the projecting portion is cut out to form the communication passage. Namely, the communication passage is disposed on the inner circumferential side of the advance angle chamber and the retard angle chamber. At the time of engine start, firstly, the fluid supplied to the advance angle chamber is exposed to a centrifugal force in association with rotation of the drive-side rotating body and the driven-side rotating body by a cranking action, so that the fluid will move to the outer circumferential side of the advance angle chamber. Next, when fluid is charged to the interior of the advance angle chamber, the fluid will move to the retard angle chamber via the communication passage. In the course of this, the direction of movement of the fluid from the advance angle chamber to the retard angle chamber across the projecting portion is opposite to the rotation acceleration (angle advance) direction, so that an inertial force associated with the rotation will affect the moving fluid. Therefore, the fluid moving in the communication passage is exposed not only to the discharge pressure from the pump, but also to the inertial force, so the fluid moves speedily.

Then, the centrifugal force is applied also to the fluid which flows out of the communication passage into the retard angle chamber, so that the fluid moves to the outer circumferential side of the retard angle chamber. Namely, no fluid will be present at the exit of the communication passage until the retard angle chamber is filled with fluid. So, the fluid of the communication passage will move smoothly to the retard angle chamber without encountering any exiting resistance. In this way, with use of the subject feature, it is possible to charge fluid to the advance angle chamber and the retard angle chamber more speedily.

According to a still further characterizing feature, the communication passage is formed by cutting out a portion of the drive-side rotating body which portion faces an outer circumferential end face of the partition portion.

With the above feature, the communication passage formed by cutting out a portion of the drive-side rotating body which portion faces an outer circumferential end face of the partition portion is disposed on the outer circumferential side of the advance angle chamber and the retard angle chamber. As described above, at the time of engine start, upon supply of fluid to the advance angle chamber, due to a centrifugal force associated with rotation of the drive-side rotating body and the driven-side rotating body, the fluid will move to the outer circumferential side of the advance angle chamber. That is, the fluid which has moved toward the outer circumferential side of the advance angle chamber will now move to the retard angle chamber via the communication passage, Therefore, the fluid amount of the advance angle chamber and the fluid amount of the retard angle chamber can be increased substantially simultaneously. Thus, even when the lock is released before the advance angle chamber and the retard angle chamber are filled with fluid, the problematic situation of the fluid amount being small only in the retard angle chamber has already been resolved. So, the fluttering of the partition portion can be restricted.

According to a still further characterizing feature:

the drive-side rotating body is comprised of an outer circumferential wall portion and front and rear wall portions which are disposed at opposed ends along the rotational axis; and the communication passage is formed by a portion of the front wall portion or the rear wall portion to which portion the partition portion is projected in the direction of the rotational axis.

In general, the front wall portion and the rear wall portion of the drive-side rotating body are provided as disc-like members, so the projection position of the partition portion in the rotational axis direction is comprised of a plane. Then, if the communication passage is formed by cutting out such planar portion of the disc-like member as provided in the above-described feature, the working for providing the above arrangement can be effected easily.

According to a still further characterizing feature;

at least one projecting portion of the plurality of projecting portions has a length in the circumferential direction set shorter than a length of the other projecting portions of the plurality of projecting portions in the circumferential direction; and the communication passage is formed in a region facing the at least one projecting portion.

If the communication passage is formed at the projecting portion having the shorter length in the circumferential direction as provided in the above-described feature, it becomes possible to allow fluid supplied to the advance angle chamber to move speedily to the retard angle chamber via the communication passage having such shorter passage length.

According to a still further characterizing feature:

between the projecting portions and the driven-side rotating body, there are separately formed a first flow passage communicated to the retard angle chamber and the communication passage, and a second flow passage communicated to the advance angle chamber and the communication passage;

when the intermediate lock mechanism is under the locked state, the fluid flows from the second flow passage through the communication passage to the first flow passage; and the first flow passage has a passage cross sectional area greater than a passage cross sectional area of the second flow passage.

With this characterizing feature, the fluid charged into the advance angle chamber will move to the retard angle chamber via the second flow passage, the communication passage and the first flow passage. In this, since the passage cross sectional area of the second flow passage communicated to the advance angle chamber is smaller than the passage cross sectional area of the first flow passage, there occurs no reduction in the charging speed of the fluid to the advance angle chamber. Next, when the fluid moves to the retard angle chamber via the communication passage, since the passage cross sectional area of the first passage is set greater than the passage cross sectional area of the second flow passage, the fluid can be discharged smoothly from the exit having the greater cross sectional area than the entrance. Consequently, there will occur no stagnation of fluid present in the communication passage and the fluid can flow smoothly to the retard angle chamber, so that the charging speed of the fluid to the retard angle chamber can be increased.

DESCRIPTION OF EMBODIMENTS

Next, embodiments of a valve opening/closing timing control device relating to the present disclosure will be explained. It should be understood, however that the present disclosure is not limited to the following embodiments, but various modifications can be made in a range not exceeding its essential spirit.

1. First Embodiment

Next, a first embodiment of the disclosure will be explained with reference to the drawings.

[Basic Configuration]

Figure 1:
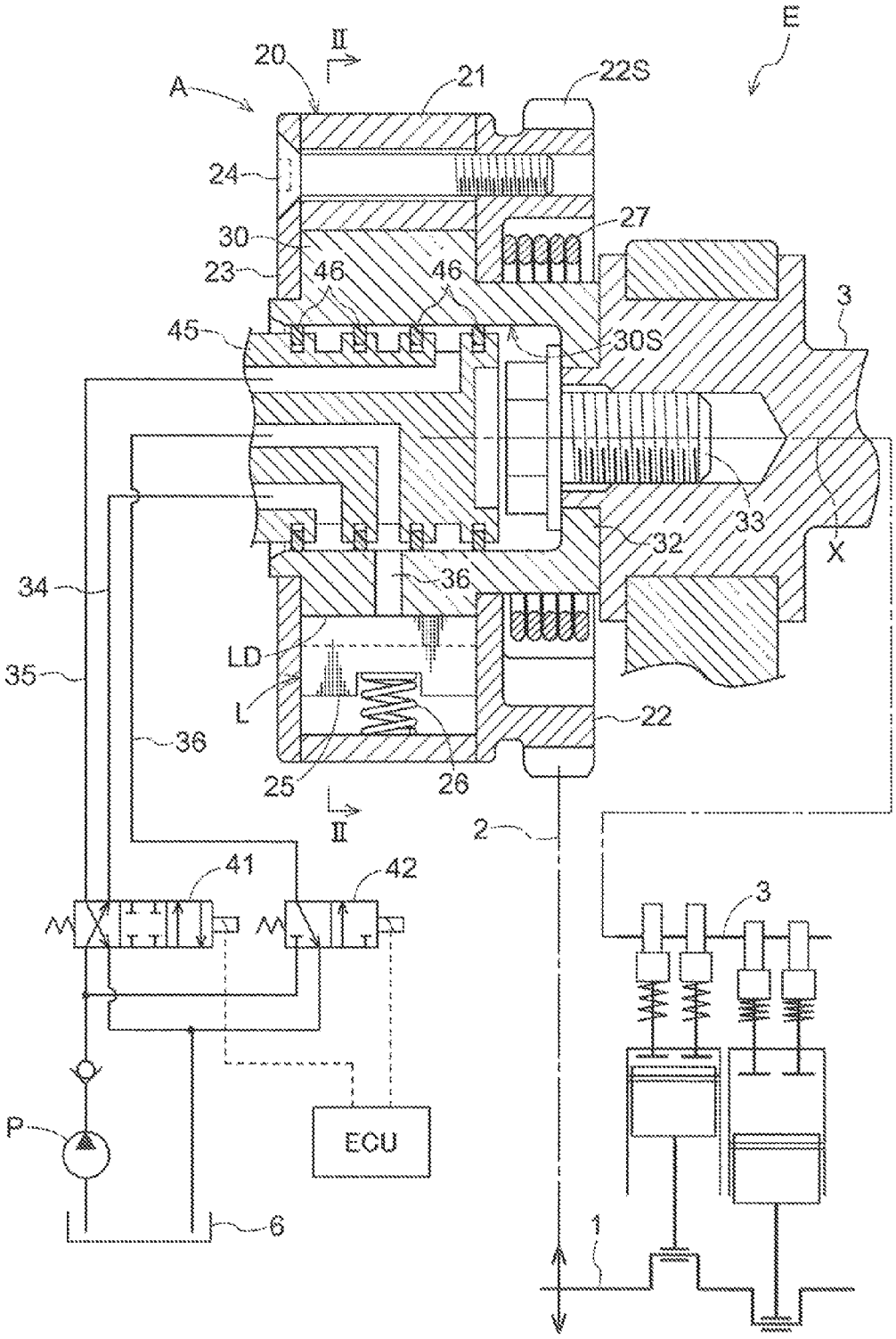
FIG. 1 is a lateral cross section schematically showing a valve opening/closing timing control device relating to a first embodiment.
Figure 2:
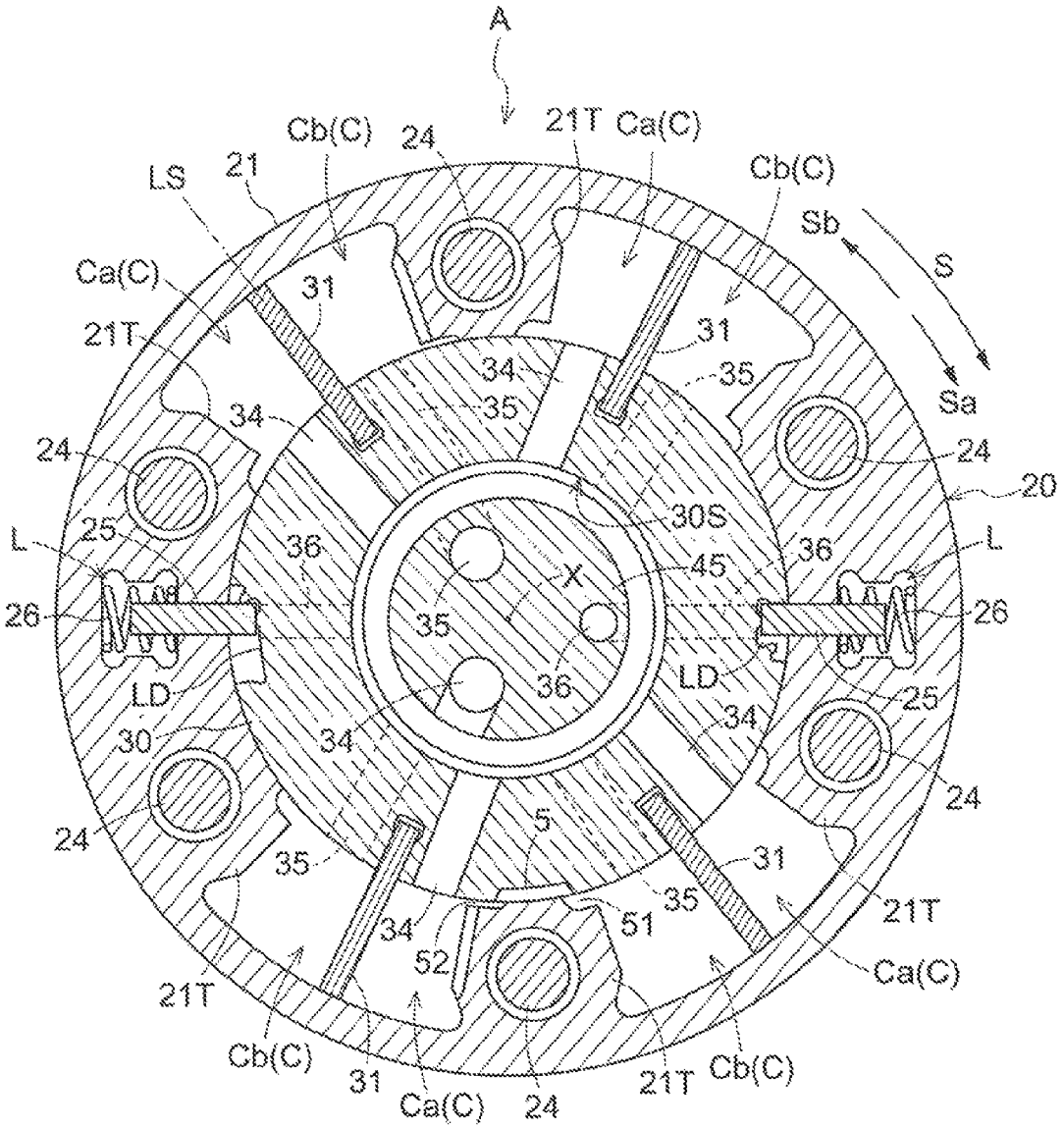
FIG. 2 is a section taken along II-II in FIG. 1 showing an intermediate lock mechanism being under a locked state.

FIG. 1 and FIG. 2 show a valve opening/closing timing control device A relating to the present disclosure. This valve opening/closing timing control device A includes an outer rotor 20 as a "drive-side rotating body", an inner rotor 30 as a "driven-side rotating body", and an intermediate lock mechanism L capable of being switched over between a locked state in which a relative rotational phase of the inner rotor 30 relative to the outer rotor 20 (this will be referred to as "relative rotational phase" hereinafter) is restrained to an intermediate lock phase LS between a most advanced angle phase and a most retarded angle phase, and an unlocked state in which the above restraint is released.

The outer rotor 20 includes a cylindrical rotor body 21 (an example of "outer circumferential wall portion"), a disc-like rear plate 22 (an example of "rear wall portion") disposed rearwardly of the rotor body 21 in a direction along a rotational axis X and a disc-like front plate 23 (an example of "front wall portion") disposed forwardly of the rotor body 21 in the direction along the rotational axis X. The outer rotor 20 is rotated in synchronism with a crankshaft 1 of an engine E as an internal combustion engine via a power transmission member 2. The inner rotor 30 is coupled to a camshaft 3 that opens/closes an intake value of a combustion chamber of the engine E and is disposed coaxially with the rotational axis X of the outer rotor 20 so as to be rotatable relative to this outer rotor 20. The intermediate lock phase LS, as shown in FIG. 2, is provided in vicinity of a center between the most advanced angle phase and the most retarded angle phase so as to allow the engine E to be operated with favorable fuel consumption efficiency. Incidentally, the intermediate lock phase LS is not limited to the phase illustrated in FIG. 2, but can be set to on more advance angle side or more retard angle side than the illustrated one.

[Drive-Side Rotating Body and Driven-Side Rotating Body]

The outer rotor 20 and the inner rotor 30 are bound (sandwiched) between the front plate 23 disposed at a front position and the rear plate 22 disposed on the opposite side (engine E side), and are coupled to each other with connecting bolts 24 as fastening members inserted from the front plate 23 to the outer rotor 20 being threaded with the rear plate 22.

At an outer circumferential position of the rear plate 22, there is integrally formed a sprocket 22S around which the power transmission member 2 such as a timing chain is wound. Between the rear plate 22 and the inner rotor 30, there is provided a torsion spring 27 for urging the inner rotor 30 in an advance angle direction Sa. The outer rotor 20 is rotatably driven by the power transmission member 2 in a direction denoted by a sign S in FIG. 2. The torsion spring 27 is configured to be capable of providing its urging force at least until the intermediate lock phase LS is reached, e.g. even when the relative rotational phase is at the most regarded angle phase.

As shown in FIG. 2, the outer rotor 20 includes a plurality of projecting portions 21T projecting from a radial outer side to a radial inner side toward the rotational axis X. Between the respective adjacent projecting portions 21T, there are formed four oil chambers C (an example of "fluid pressure chamber") in distribution. Incidentally, in the instant embodiment, the oil chambers C are provided at four positions. However, this is not particularly limiting, but the oil chambers C can be provided at three positions, for instance.

The inner rotor 30 defines an inner circumferential face 30S which is formed like a cylinder inner face coaxial with the rotational axis X and defines also a cylindrical outer circumferential face centering about the rotational axis X.

Into this outer circumferential face, four vane portions 31 (an example of "partition portion") formed like plates extending toward the radial outer side of the rotational axis X are fitted. The vane portion 31 is urged by e.g. a spring in a direction away from the rotational axis X. Incidentally, in the above, the vane portion 31 is formed like a plate and the intermediate lock mechanism L is accommodated in the projecting portion 21T. Instead of this, the vane portion 31 can be formed like a block and the intermediate lock mechanism L can be accommodated in the projecting portion 21T along the rotational axis X.

With the above-described arrangement, the plurality of oil chambers C are partitioned from each other by the vane portions 31, so that an advance angle chamber Ca is formed on a counterclockwise side relative to the vane portion 31 and a retard angle chamber Cb is formed on a clockwise side relative thereto. The outer rotor 20 and the inner rotor 30 are rotatable relative to each other by a range of the vane portion 31 movable within the oil chamber C.

At one end portion of the inner rotor 30 in the direction along the rotational axis X, a flange-like portion 32 is formed. And, at a hole portion located at an inner circumferential position of this flange-like portion 32, a connecting bolt 33 is inserted, thus coupling the inner rotor 30 to the camshaft 3. Further, to an inner circumferential face 30S of the inner rotor 30, a passage forming shaft portion 45 is inserted, and this passage forming shaft portion 45 defines an advance angle passage 34, a retard angle passage 35 and a lock passage 36. Further, there are provided a phase control valve 41 (OCV: oil control valve) and a lock control valve 42 (OSV: oil switching valve) coupled to the passage forming shaft portion 45. In an outer circumferential face of the passage forming shaft portion 45, there are formed an annular groove portion communicated to a port of the phase control valve 41 and an annular groove portion communicated to a port of the lock control valve 42. And, in order to separate these groove portions from each other, between the outer circumference of the passage forming shaft portion 45 and the inner circumferential face 30S of the inner rotor 30, there are provided a plurality of seals 46.

[Intermediate Lock Mechanism]

As shown in FIG. 2, in the outer rotor 20, two projecting portions 21T having a large circumferential width are formed in opposition to each other across the rotational axis X therebetween. And, in these projecting portions 21T, there are provided two intermediate lock mechanisms L. Each intermediate lock mechanism L, which is a restraining body projectable and retractable along a direction perpendicular to the rotational axis X, is comprised of a plate-like locking member 25, a lock spring 26 for urging the locking member 25 in an engaging direction and a lock recess LD in which the locking member 25 engages. When the relative rotational phase is at the intermediate lock phase LS shown in FIG. 2, the two locking members 25 engage into the corresponding lock recesses LD by the urging forces of the lock springs 26, thus retaining the rotational phase at the intermediate lock phase LS. Incidentally, the shape of the locking member 25 is not limited to the plate-like shape, but can be a rod-like phase, for instance. Further, the number of the intermediate lock mechanism L is not limited to two. Instead, one or three such mechanisms can provided.

The lock recess LD is comprised of a shallow groove and a deep groove continuous with each other in the circumferential direction. As shown in FIG. 2, under the intermediate lock phase LS (locked state) when no oil (an example of "fluid") is present in the lock recess LD, one locking member 25 comes into contact with an advance angle direction Sa end portion of the deep groove of the lock recess LD, thus inhibiting change of the inner rotor 30 in the retard angle direction Sb, whereas the other locking member 25 comes into contact with a retard angle direction Sb end portion of the deep groove of the lock recess LD, thus inhibiting change of the inner rotor 30 in the advance angle direction Sa.

[Phase Control]

The phase control valve 41 switches over supply, discharge and retention of oil to/from/at the advance angle chamber Ca and the retard angle chamber Cb. In particular, as one of an advance angle passage 34 and a retard angle passage 35 is selected to be supplied with oil and oil is discharged from the other, there is realized an operation of displacing a relative rotational phase of the valve opening/closing timing control device A to the advance angle direction Sa or the retard angle direction Sb.

The lock control valve 42 (OSV: oil switching valve) realizes retention and release of the locked state of the intermediate lock mechanism L of the valve opening/closing timing control device A. In particular, for retaining the locked state, oil discharge is effected from the lock passage 36. For releasing the locked state, oil is supplied to the lock passage 36.

The phase control valve 41 and the lock control valve 42 comprise electromagnetic valves, which respectively include, though not shown, a spool, a spring and an electromagnetic solenoid. Further, in the instant embodiment, there is provided a single pump P which is driven by the engine E and configured to supply oil to the phase control valve 41 and the lock control valve 42 from an oil pan 6. Incidentally, this disclosure is not limited to such single pump. Instead, pumps can be provided individually for the phase control valve 41 and the lock control valve 42.

The phase control valve 41 and the lock control valve 42 are controlled by control signals from an ECU (engine control unit). The ECU is configured to set a target relative rotational phase and to output control signals to the phase control valve 41 and the lock control valve 42 therefor, based on detection signals from a phase sensor (not shown) for detecting a relative rotational phase between the outer rotor 20 and the inner rotor 30, a speed sensor (not shown) for detecting a rotational speed of the engine E, and so on.

Incidentally, instead of providing the phase control valve 41 and the lock control valve 42 separately, there can be provided a single OCV for effecting switchover of supply, discharge, retention of oil to/from/at the advance angle chamber Ca and the retard angle chamber Cb and effecting also switchover of supply and discharge of oil to/from the intermediate lock mechanism L. As an example of oil control in the case of such arrangement, the spool experiences changes in the order of: (1) advance angle chamber Ca supply, retard angle chamber Cb discharge, intermediate lock mechanism L discharge; (2) advance angle chamber Ca supply, retard angle chamber Cb discharge, intermediate lock mechanism L supply; (3) advance angle chamber Ca retention, retard angle chamber Cb retention, intermediate lock mechanism L supply; (4) advance angle chamber Ca discharge, retard angle chamber Cb supply, intermediate lock mechanism L supply; (5) advance angle chamber Ca discharge, retard angle chamber Cb supply, intermediate lock mechanism L discharge.

At the time of stop of the engine E, driving of the pump P is stopped, so that oils present inside the advance angle chamber Ca and the retard angle chamber Cb are discharged into the oil pan 6. In this, oil is discharged from the lock passage 36, thus realizing a locked state. Next, when the engine E is started, a starter motor (not shown) is driven, thus initiating a cranking action. Namely, at the time of starting the engine E, the locked state is maintained, so that the cranking action can proceed under the condition of the relative rotational phase being restrained to a phase suitable for engine start. Subsequently, after oil is supplied to the advance angle chamber Ca, oil is supplied also to the intermediate lock mechanism L, thus releasing the locked state, so that a desired phase control will be executed thereafter.

Incidentally, if the locked state is released when the amount of oil present in the retard angle chamber Cb is small, the camshaft 3 may be rotated repeated in the advance angle direction Sa and the retard angle direction Sb as being exposed to a reaction force from the intake valve, so that fluttering of the relative rotational phase can occur, thus rendering the phase control unstable. Moreover, the vane portion 31 will come into contact with the lateral wall of the retard angle chamber Cb repeatedly, thus inviting noise generation.

[Communication Passage]

Then, in the present embodiment, there is provided a communication passage 5 configured to establish communication between the advance angle chamber Ca and the retard angle chamber Cb which are positioned adjacent each other in the circumferential direction, when the intermediate lock mechanism L is under the locked state. More particularly, as shown in FIG. 2, the communication passage 5 is formed by cutting out a portion of the outer circumferential face of the inner rotor 30 which portion faces the projecting portion 21T under the locked state. This communication passage 5 has a size minimally required for allowing oil movement from the advance angle chamber Ca to the retard angle chamber Cb and is formed by cutting out a portion of the outer circumferential face of the inner rotor 30 which portion faces one projecting portion 21T having a relatively small width. This cutout can be formed at a corner portion or a lateral face of the inner rotor 30. If the cutout is formed at a corner portion of the inner rotor 30, a work for forming this can be carried out easily. On the other hand, if the cutout is formed at a lateral face of the inner rotor 30, this will restrict leakage of oil from the gap between the inner rotor 30 and the rear plate 22 or the front plate 23, so that the oil supplied into the advance angle chamber Ca can be caused to flow to the retard angle chamber Cb in a reliable manner.

Further, in the instant embodiment, as shown in FIG. 2, between the projecting portion 21T and the inner rotor 30, there are formed separately a first flow passage 51 communicated to the retard angle chamber Cb and the communication passage 5 and a second flow passage 52 communicated to the advance angle chamber Ca and the communication passage 5. The first flow passage 51 has a passage cross sectional area greater than a passage cross sectional area of the second flow passage 52.

Figure 3:
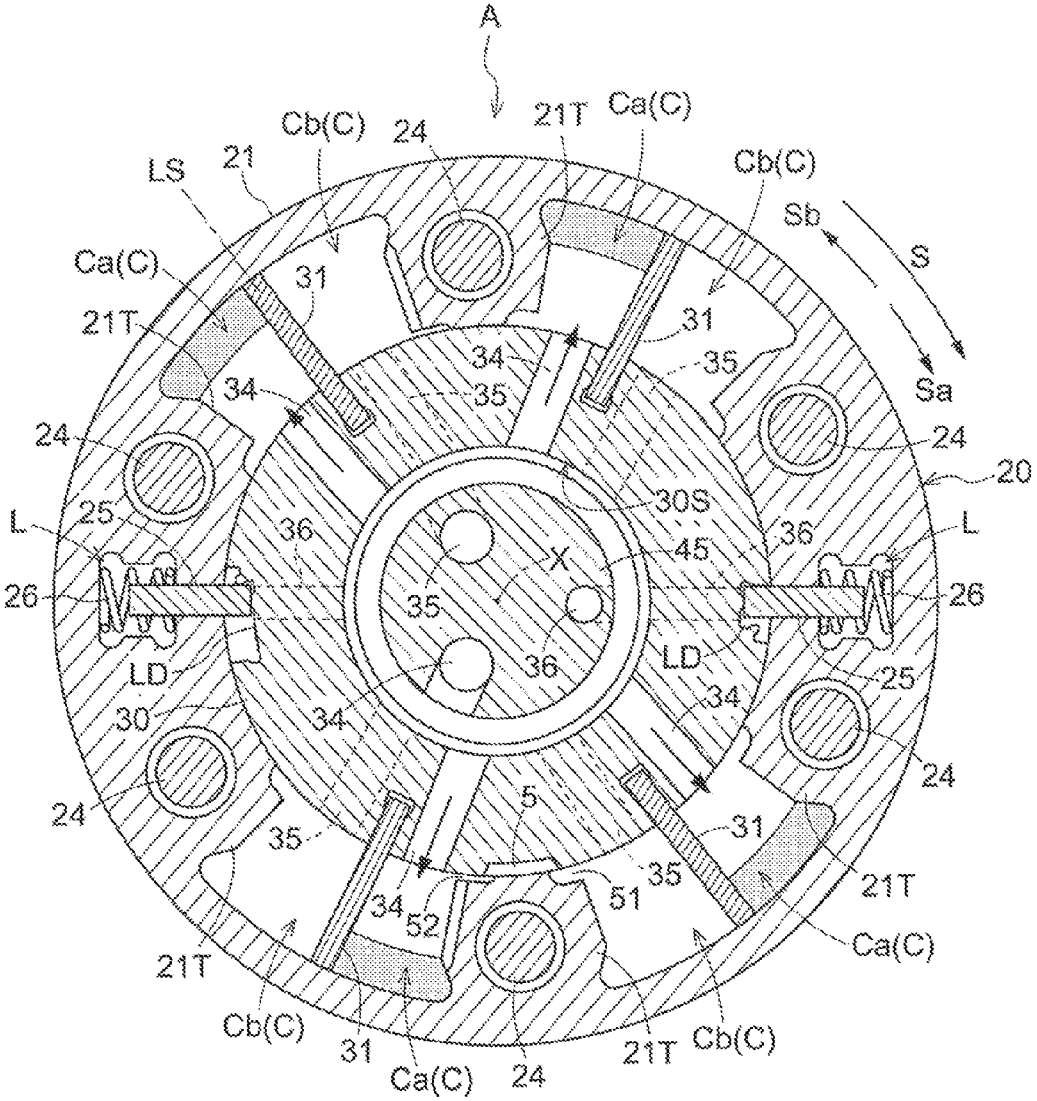
FIG. 3 is a section taken along II-II in FIG. 1 showing a situation of fluid movement after engine start.

Next, with reference to FIGS. 3-6, modes of oil flow at the time of starting the engine E will be explained. When the engine E is started, by a cranking action, the outer rotor 20 is driven to rotate in the direction indicated by the sign S (advance angle direction Sa) via the power transmission member 2. In this, supply of oil to the advance angle chamber Ca is started and as illustrated in FIG. 3, a centrifugal force associated with the rotation of the outer rotor 20 is provided so that the oil moves toward the outer circumference side of the advance angle chamber Ca.

Figure 4:
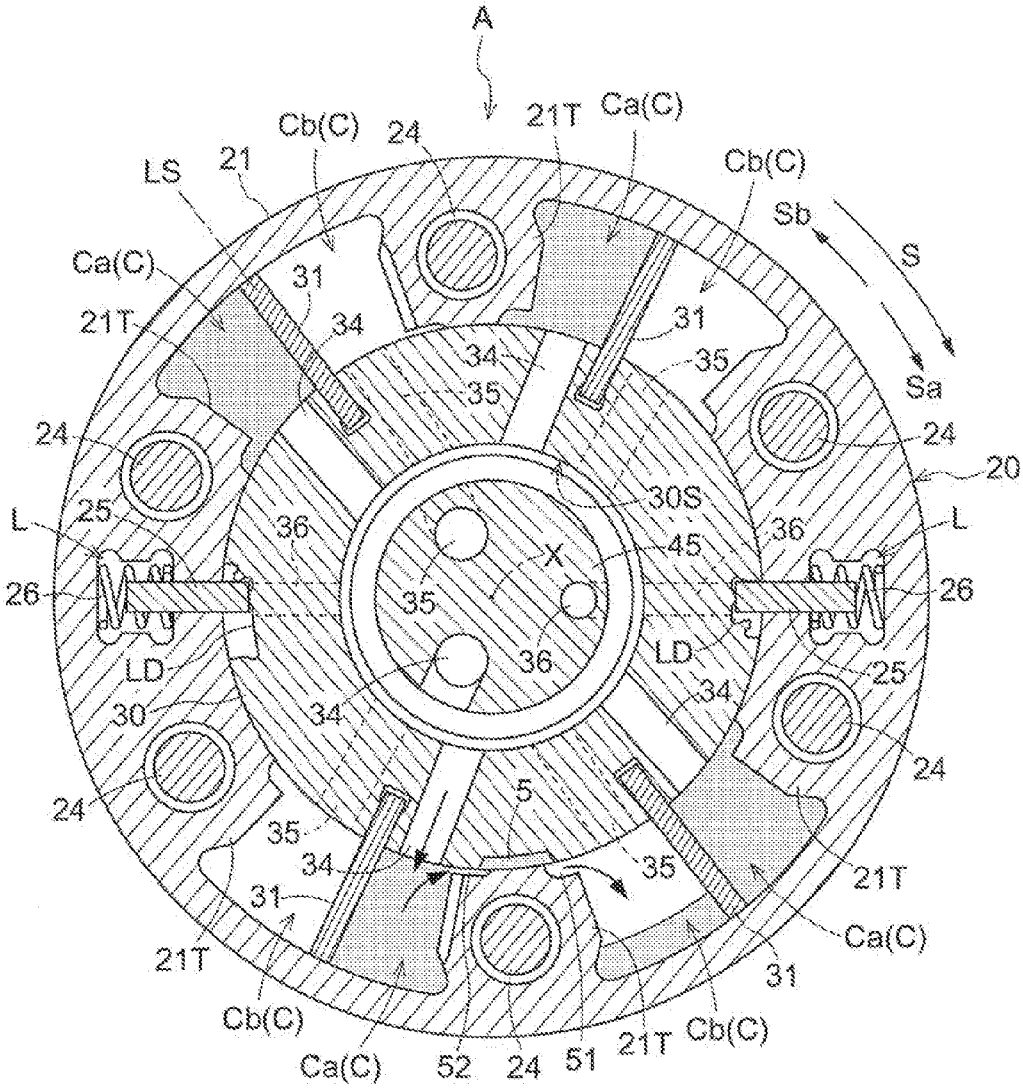
FIG. 4 is a section taken along II-II in FIG. 1 showing a situation of fluid movement after engine start.

Next, upon filling of the oil in the advance angle chamber Ca, as illustrated in FIG. 4, the oil passing through the communication passage 5 moves from the advance angle chamber Ca to the retard angle chamber Cb. In the course of this, in addition to a discharging force of the pump P, an inertial force associated with the rotation of the outer rotor 20 is also effective and the oil moves to the retard angle chamber Cb. Further, the oil flown into the retard angle chamber Cb is exposed also to the inertial force associated with the rotation of the outer rotor 20, like the advance angle chamber Ca, so the oil moves toward the outer circumference side of the retard angle chamber Cb. As a result, since no oil is present at the exit of the communication passage 5 until the retard angle chamber Cb is filled with oil, the oil of the communication passage 5 will encounter no exit resistance so that it can smoothly flow into the retard angle chamber Cb. Moreover, since the passage cross sectional area of the first flow passage 51 which is the exit side is larger than the passage cross sectional area of the second flow passage 52 which is on the entrance side, there occurs no stagnation of oil in the communication passage 5, and the oil can flow into the retard angle chamber Cb even more smoothly.

Figure 5:
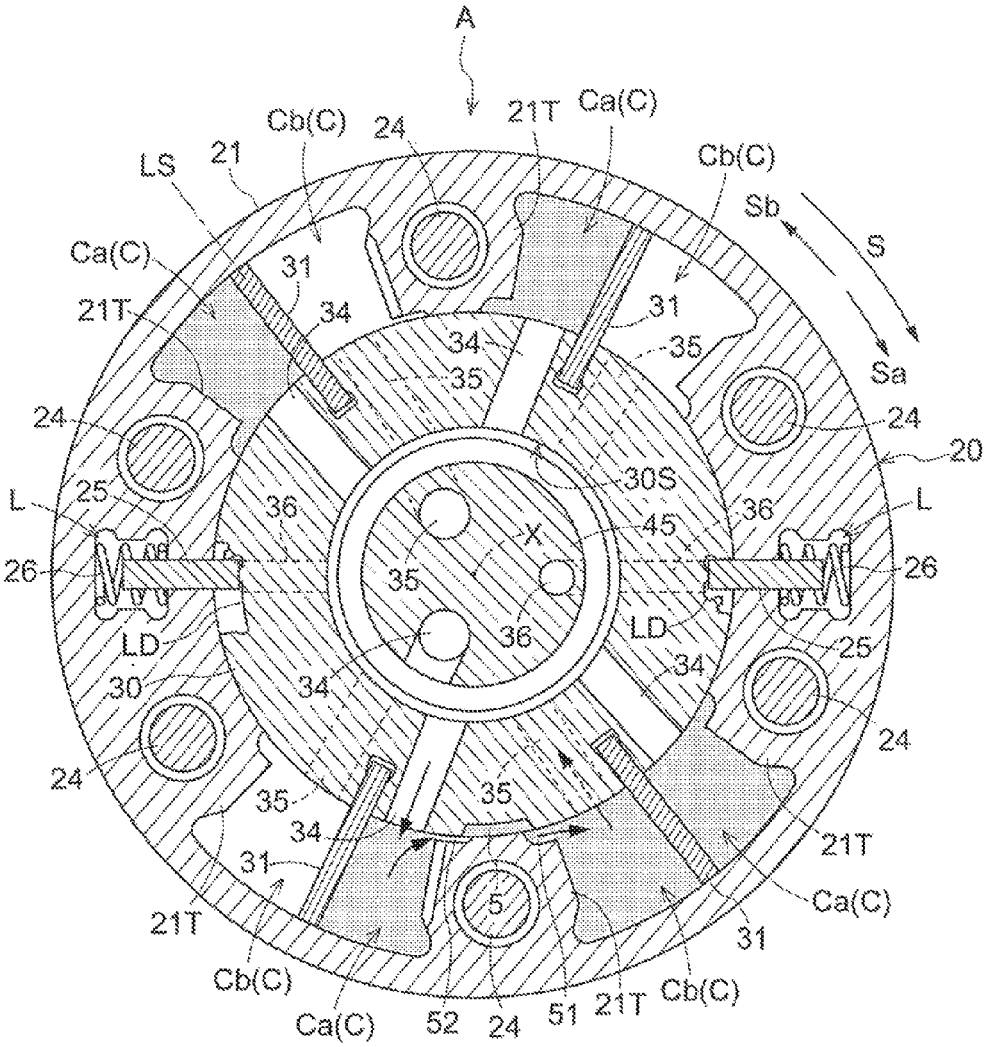
FIG. 5 is a section taken along II-II in FIG. 1 showing a situation of fluid movement after engine start.
Figure 6:
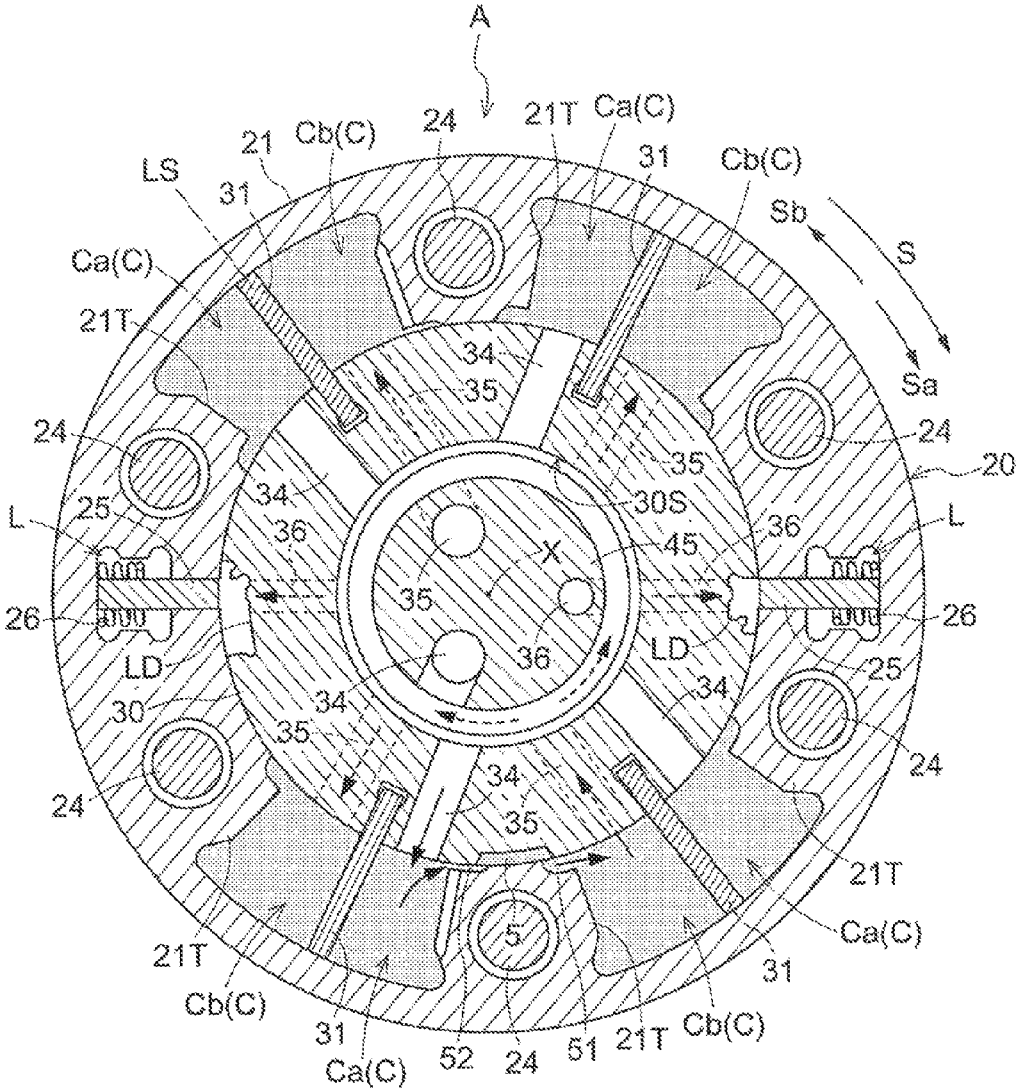
FIG. 6 is a section taken along II-II in FIG. 1 showing a situation of fluid movement after engine start.

Subsequently, as shown in FIG. 5 and FIG. 6, when one retard angle chamber Cb is filled with oil, via the annular groove portions formed in the outer circumferential face of the flow passage forming shaft portion 45 communicated to the respective retard angle chambers Cb, oil movement to the other retard angle chambers Cb is started. In the course of this, under the effect of the inertial force associated with the rotation of the outer rotor 20, movement into the other retard angle chambers Cb via the annular groove portions can proceed speedily. Next, as shown in FIG. 6, when the advance angle chamber Ca and the retard angle chamber Cb are filled with oil, oil is supplied to the intermediate lock mechanism L, thus releasing the locked state.

The fluid movement mechanisms described above can function effectively even with a single OCV. Especially, with the single OCV, the control will proceed for instance such that at the time of starting the engine E, oil is supplied only to the advance angle chamber Ca and then oil is supplied to the intermediate lock mechanism L for releasing the locked state. At the time of release of the lock, oil is supplied also to the retard angle chamber Cb, so there is realized an operation with stable relative rotational phase. On the other hand, in case the phase control valve 41 and the lock control valve 42 are provided, there is no need to effect switchover of the phase control valve 41 for supplying oil to the advance angle chamber Ca and the retard angle chamber Cb. For this reason, time loss associated with switchover of the phase control valve 41 is eliminated, so that the timing of the lock release can be quickened.

2. Second Embodiment

Figure 7:
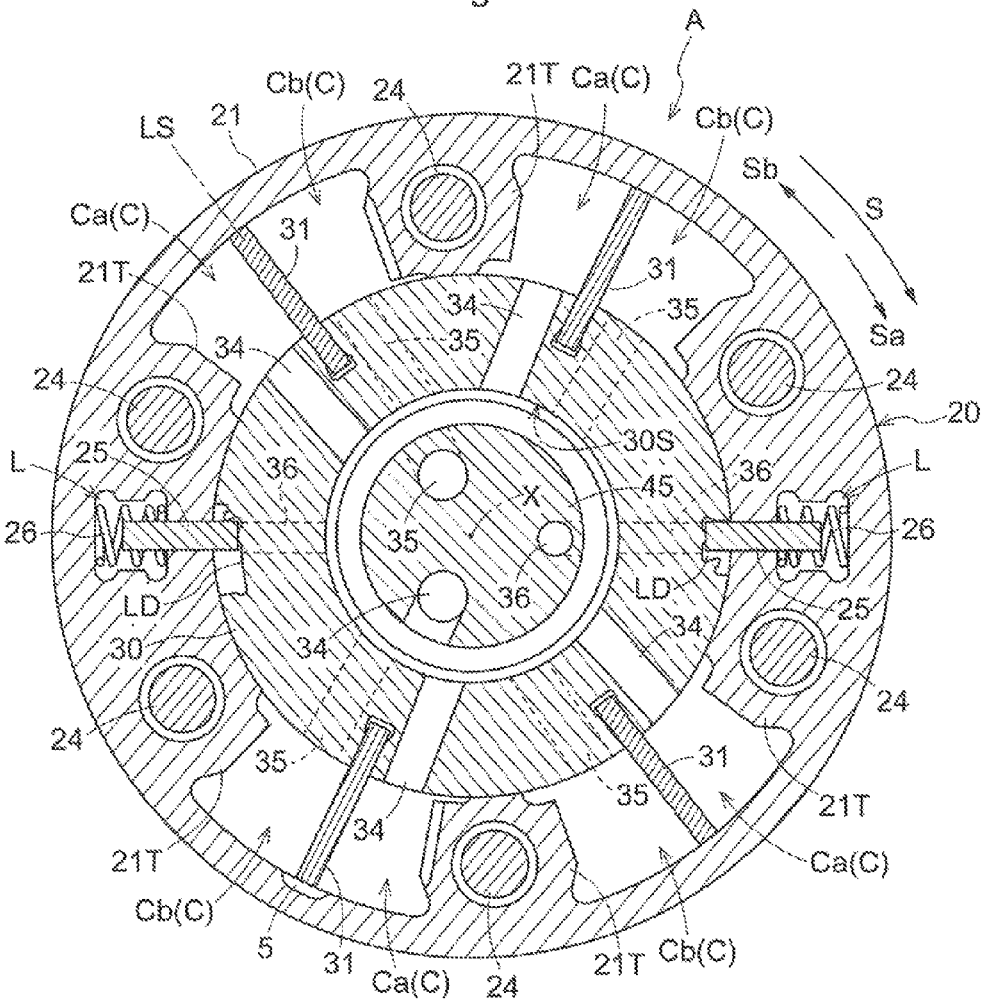
FIG. 7 is a section taken along II-II in FIG. 1 relating to a second embodiment.

A second embodiment will now be explained regarding its differences from the first embodiment only, with reference to FIG. 7. Incidentally, for better understanding of the drawing, the following explanation will be made with denoting the same members as the first embodiment with the same reference marks/numerals.

In this embodiment, the communication passage 5 is formed by cutting out a portion of the outer rotor 20 which portion comes into opposition to the outer circumferential end face of the vane portion 31 under the locked state. This cutout can be formed at a corner portion or an inner face of the outer rotor 20. In this case, at the time of starting the engine E, with the effect of the centrifugal force associated with rotation of the outer rotor 20, the oil of the advance angle chamber Ca moves toward the outer circumferential side and at the same time it starts moving to the retard angle chamber Cb via the communication passage 5. Namely, the oil supply to the advance angle chamber Ca and the oil supply to the retard angle chamber Cb take place simultaneously. For this reason, even if lock release is effected before the advance angle chamber Ca and the retard angle chamber Cb are filled with oil, the problematic situation of the amount of oil being small in the retard angle chamber Cb only will have already been resolved. So, fluttering of the vane portion 31 can be restricted at earlier stage.

3. Third Embodiment

Figure 8:
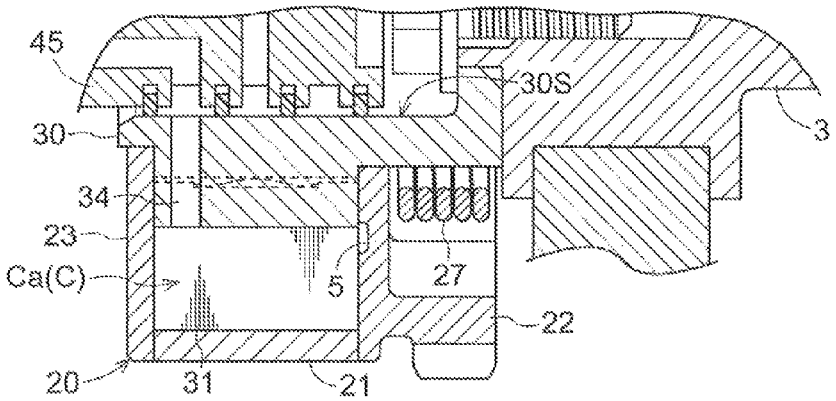
FIG. 8 is a partial section showing a valve opening/closing timing control device relating to a third embodiment.

A third embodiment will now be explained regarding its differences from the first embodiment only, with reference to FIG. 8. Incidentally, for better understanding of the drawing, the following explanation will be made with denoting the same members as the first embodiment with the same reference marks/numerals.

In this embodiment, the communication passage 5 is formed by cutting out a portion of one of the rear plate 22 and the front plate 23 to which portion the vane portion 31 under the locked state is projected in the direction of the rotational axis X. FIG. 8 shows the rear plate 22 with a portion thereof being cut out.

On the near side in the illustration, the advance angle chamber Ca is present and on the far side in the illustration across the vane portion 31, the retard angle chamber Cb is present. Namely, when the intermediate lock mechanism L is under the locked state, the communication passage 5 establishes communication between the advance angle chamber Ca and the retard angle chamber Cb across the vane portion 31.

In this embodiment, the rear plate 22 and the front plate 23 are disc-like members; and the position to which the vane portion 31 is projected in the direction of the rotational axis X is constituted of a plane. For this reason, if the communication passage 5 is formed by cutting out a portion of of the plane of the disc-like member, working using a cutter tool or a mold can be effected easily.

4. Other Embodiments (1) In the foregoing embodiment, the communication passage 5 is formed by cutting out a portion of the inner rotor 30 which portion faces one projecting portion 21T. Alternatively, it can be formed by cutting out a portion of the inner rotor 30 facing two or more projecting portions 21T. Similarly, the communication passage 5 is not limited to the one formed by cutting out a portion of the outer rotor 20 facing the outer circumferential end face of one vane portion 31, but can be formed by cutting out a portion of the outer rotor 20 facing outer circumferential faces of two or more vane portions 31. Further, this disclosure is not limited to the arrangement of providing the communication passage 5 in either one of the rear plate 22 and the front plate 23; instead, the passage can be provided in both of them or provided at a position corresponding to two or more vane portions 31. If a plurality of communication passages 5 are provided as described above, the charging of oil to the advance angle chamber Ca and the retard angle chamber Cb can be effected even more speedily.

(2) In the foregoing embodiment, the oil supply is started in the advance angle chamber Ca. Instead, the oil supply can be started in the retard angle chamber Cb. In this case too, at the time of starting the engine E, oil charging to the advance angle chamber Ca and the retard angle chamber Cb can be effected speedily via the communication passage 5.

(3) In case the single OCV is provided in the foregoing embodiment, this single OCV can be coupled to the flow passage forming shaft portion 45 formed on the inner side of the inner rotor 30, or the single OCV can be disposed on the inner side of the inner rotor 30 and along the rotational axis X. Further, this disclosure is not limited the arrangement of the foregoing embodiment in which oil is supplied from the front plate 23 side. Instead, the oil can be supplied from the rear plate 22 side to the phase control valve 41 and the lock control valve 42 disposed on the camshaft 3 side or to the single OCV disposed on the inner side of the inner rotor 30 along the rotational axis X.

(4) In the foregoing embodiment, the vane portions 31 are formed in the inner rotor 30 and the projecting portions 21T are formed in the outer rotor 20. Instead, the vane portions 31 (an example of "projecting portion") can be formed in the outer rotor 20 and the projecting portions 21T (an example of "partition portion") can be formed in the inner rotor 30. In this case, the communication passage 5 will be formed by cutting out a portion of the outer rotor 20 facing the projecting portion 21T or a portion of the inner rotor 30 facing the outer circumferential end face of the vane portion 31.

(5) The valve opening/closing timing control device A of this disclosure can be configured also to control opening/closing timing of not only an intake valve, but also an exhaust valve.

INDUSTRIAL APPLICABILITY

The present disclosure is applicable to a valve opening/closing timing control device for an internal combustion engine of an automobile, etc.

REFERENCE SIGNS LIST

1: crankshaft
3: camshaft
5: communication passage
20: outer rotor (drive-side rotating body)
21: rotor body (outer circumferential wall portion)
21T: projecting portion
22: rear plate (rear wall portion)
23: front plate (front wall portion)
30: inner rotor (driven-side rotating body)
31: vane portion (partition portion)
51: first flow passage
52: second flow passage
C: oil chamber (fluid pressure chamber)
Ca: advance angle chamber
Cb: retard angle chamber
E: engine (internal combustion engine)
L: intermediate lock mechanism
LS: intermediate lock phase
P: pump
X: rotational axis

The invention claimed is:

1. A valve opening/closing timing control device comprising:

a drive-side rotating body rotatable in synchronism with a crankshaft of an internal combustion engine, the drive-side rotating body having a plurality of projecting portions that project from a radial outer side to a radial inner side toward a rotational axis;

a driven-side rotating body surrounded by the drive-side rotating body and having a partition portion extending toward the radial outer side at a position between adjacent projecting portions of the plurality of projecting portions, thus forming an advance angle chamber and a retard angle chamber between the drive-side rotating body and the drive-side rotating body, the driven-side rotating body being rotatable together with a valve opening/closing camshaft;

an intermediate lock mechanism switchable between a locked state in which a relative rotational phase of the driven-side rotating body relative to the drive-side rotating body is restrained to an intermediate lock phase between a most advanced angle phase and a most retarded angle phase and an unlocked state in which the restraint is released;

a pump configured to supply fluid to the advance angle chamber, the retard angle chamber or the intermediate lock mechanism; and a communication passage configured to establish communication between the advance angle chamber and the retard angle chamber which are located adjacent each other in a circumferential direction, when the intermediate lock mechanism is under the locked state;

wherein the communication passage is formed by cutting out a portion of the driven-side rotating body which portion faces an end portion of one of the plurality of projecting portions.

2. The valve opening/closing timing control device according to claim 1, wherein:

at least one projecting portion of the plurality of projecting portions has a length in the circumferential direction set shorter than a length of remaining projecting portions of the plurality of projecting portions in the circumferential direction; and the communication passage is formed in a region facing the at least one projecting portion.

3. The valve opening/closing timing control device according to claim 1, wherein:

between the plurality of projecting portions and the driven-side rotating body, there are separately formed a first flow passage communicated to the retard angle chamber and the communication passage, and a second flow passage communicated to the advance angle chamber and the communication passage;

when the intermediate lock mechanism is under the locked state, the fluid flows from the second flow passage through the communication passage to the first flow passage; and the first flow passage has a passage cross sectional area greater than a passage cross sectional area of the second flow passage.

4. A valve opening/closing timing control device comprising:

a drive-side rotating body rotatable in synchronism with a crankshaft of an internal combustion engine, the drive-side rotating body having a plurality of projecting portions that project from a radial outer side to a radial inner side toward a rotational axis;

a driven-side rotating body surrounded by the drive-side rotating body and having a partition portion extending toward the radial outer side at a position between adjacent projecting portions of the plurality of projecting portions, thus forming an advance angle chamber and a retard angle chamber between the drive-side rotating body and the drive-side rotating body, the driven-side rotating body being rotatable together with a valve opening/closing camshaft;

an intermediate lock mechanism switchable between a locked state in which a relative rotational phase of the driven-side rotating body relative to the drive-side rotating body is restrained to an intermediate lock phase between a most advanced angle phase and a most retarded angle phase and an unlocked state in which the restraint is released;

a pump configured to supply fluid to the advance angle chamber, the retard angle chamber or the intermediate lock mechanism; and a communication passage configured to establish communication between the advance angle chamber and the retard angle chamber which are located adjacent each other in a circumferential direction, when the intermediate lock mechanism is under the locked state;

wherein the communication passage is formed by cutting out a portion of the drive-side rotating body which portion faces an outer circumferential end face of the partition portion.

5. A valve opening/closing timing control device comprising:

a drive-side rotating body rotatable in synchronism with a crankshaft of an internal combustion engine, the drive-side rotating body having a plurality of projecting portions that project from a radial outer side to a radial inner side toward a rotational axis;

a driven-side rotating body surrounded by the drive-side rotating body and having a partition portion extending toward the radial outer side at a position between adjacent projecting portions of the plurality of projecting portions, thus forming an advance angle chamber and a retard angle chamber between the drive-side rotating body and the drive-side rotating body, the driven-side rotating body being rotatable together with a valve opening/closing camshaft;

an intermediate lock mechanism switchable between a locked state in which a relative rotational phase of the driven-side rotating body relative to the drive-side rotating body is restrained, at an intermediate lock position, to an intermediate lock phase between a most advanced angle phase and a most retarded angle phase and an unlocked state in which the restraint is released;

a pump configured to supply fluid to the advance angle chamber, the retard angle chamber or the intermediate lock mechanism; and a communication passage configured to establish communication between the advance angle chamber and the retard angle chamber which are located adjacent each other in a circumferential direction, when the intermediate lock mechanism is under the locked state;

wherein the drive-side rotating body is comprised of an outer circumferential wall portion and front and rear wall portions which are disposed at opposed ends along the rotational axis; and the communication passage is formed on the front wall portion or the rear wall portion at the intermediate lock position.

* * * * *